US009427062B2

(12) United States Patent
Eberlein et al.

(10) Patent No.: US 9,427,062 B2
(45) Date of Patent: Aug. 30, 2016

(54) MULTIPLE LEVEL CONTAINER

(71) Applicant: HCT GROUP HOLDINGS LIMITED, Central (HK)

(72) Inventors: David Jeffrey Eberlein, Los Angeles, CA (US); Derrick Chang, Los Angeles, CA (US)

(73) Assignee: HCT GROUP HOLDINGS LIMITED, Hong Kong (HK)

( * ) Notice: Subject to any disclaimer, the term of this patent is extended or adjusted under 35 U.S.C. 154(b) by 0 days.

(21) Appl. No.: 14/795,903

(22) Filed: Jul. 10, 2015

(65) Prior Publication Data

US 2016/0007714 A1 Jan. 14, 2016

Related U.S. Application Data

(60) Provisional application No. 62/023,011, filed on Jul. 10, 2014.

(51) Int. Cl.

| | |
|---|---|
| ***B65D 1/24*** | (2006.01) |
| ***A45D 33/20*** | (2006.01) |
| ***A45D 33/26*** | (2006.01) |
| ***A45D 40/22*** | (2006.01) |
| ***A45D 33/00*** | (2006.01) |

(52) U.S. Cl.

CPC ..... *A45D 33/20* (2013.01); *A45D 33/008* (2013.01); *A45D 33/26* (2013.01); *A45D 40/22* (2013.01); *A45D 2040/225* (2013.01)

(58) Field of Classification Search

CPC .... A45D 33/20; A45D 33/00; A45D 33/003; A45D 33/006; A45D 33/008; A45D 33/28; A45D 40/22; A45D 40/221; A45D 40/222; A45D 40/24; A45D 2040/225

USPC ..... 132/287, 293–295, 301, 302, 304, 305; 206/581; 220/23.83, 23.88, 521, 522, 220/523; D3/295, 901

See application file for complete search history.

(56) References Cited

U.S. PATENT DOCUMENTS

| | | | | |
|---|---|---|---|---|
| 4,744,376 | A * | 5/1988 | Verducci | A45C 11/24 132/297 |
| 2002/0096185 | A1* | 7/2002 | Givens | 132/287 |
| 2008/0023023 | A1* | 1/2008 | Boye et al. | 132/294 |
| 2013/0284202 | A1* | 10/2013 | Limongi et al. | 132/316 |

FOREIGN PATENT DOCUMENTS

| | | |
|---|---|---|
| EP | 2471406 A1 | 7/2012 |
| JP | S5945015 U | 3/1984 |

OTHER PUBLICATIONS

PCT Appl. No. US2015/039912, The International Search Report and the Written Opinion of the International Searching Authority mailed Sep. 25, 2015.

* cited by examiner

*Primary Examiner* — Steven A. Reynolds
*Assistant Examiner* — James A Pagan
(74) *Attorney, Agent, or Firm* — Seager, Tufte & Wickhem LLP

(57) ABSTRACT

Cosmetic containers having multiple levels, a lid, and a base, in which the opening of the lid also provides access to at least first and second levels having one or more compartments for products and/or applicators. The base may contain a first level, and be coupled via a first linkage to a second level. The lid may be coupled by a pivot assembly to the base and to the second level by a second linkage. The overall assembly may allow access to both the first level and the second level on opening the lid.

20 Claims, 8 Drawing Sheets

MULTIPLE LEVEL CONTAINER

CROSS REFERENCE TO RELATED APPLICATIONS

The present application claims the benefit of and priority U.S. Provisional Application No. 62/023,011, filed Jul. 10, 2014, the disclosure of which is incorporated herein by reference.

FIELD

The present application relates generally to a multiple level container with a base and lid, and in particular, to a multiple level container providing simultaneous access to multiple levels of products.

BACKGROUND

Vessels or containers exist that are portable, convenient to use, and designed to contain products for use. These types of portable vessels usually consist of a base and a lid, that when assembled together provide an effective barrier for containing the product. The base and/or lid are typically made of a glass, a plastic, a metal, combinations of the foregoing, or the like.

Such vessels are used in the cosmetics and personal care industries for containing a product to be applied to a body. Such products may be volatile and/or aggressive. Conventional base and lid assemblies may be opened and closed using different types of mechanisms. For example, some conventional base and lid assemblies are opened and closed using hinge assemblies.

Although portable containers exist, there is a continuing need for more and different containers. Particularly, there is a continuing need for containers for cosmetics that facilitate quick and easy access to products.

BRIEF DESCRIPTION OF THE DRAWINGS

There is shown in the drawings embodiments that are presently preferred, it being understood, however, that the disclosure is not limited to the specific instrumentalities disclosed. Included in the drawings are the following Figures.

DETAILED DESCRIPTION OF EXEMPLARY EMBODIMENTS

As described above, some conventional containers include a base and a lid that are opened and closed using hinge assemblies. These conventional containers may include a tray or level that rotates or pivots about the same axis as the lid hinge. Some of these containers include a product (e.g., a sponge) on the tray and one or more other products (cosmetics to be applied to a user) under the tray. To apply the cosmetic products, the lid is opened, the sponge is removed from the tray, the tray is moved to access the cosmetic products and the sponge is then used to apply the products. Accordingly, these conventional containers do not provide simultaneous access to multiple levels (e.g., a sponge level and a product level).

Some embodiments provide a multiple level container providing simultaneously access to multiple levels of products. Embodiments provide a multiple level container configured to have a first product holding level and a second product holding level disposed within a base of the container when the container is closed and the second product holding level raised from the base when the container is opened to a position for the products to be accessed. Embodiments provide a multiple level container having linkage assemblies that cause the second product holding level of the container to move as a function of movement of the lid.

Figure 1A:
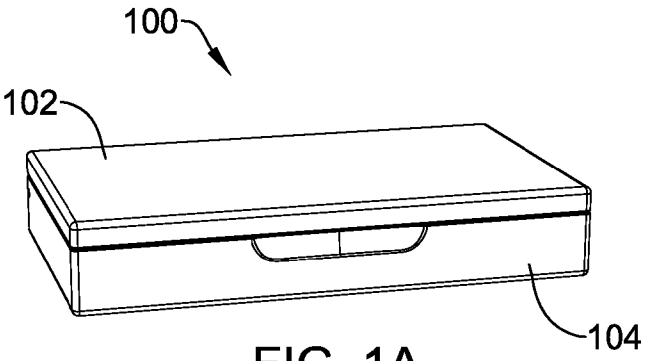
FIG. 1A is a perspective view of a multiple level container in a closed position according to some embodiments disclosed herein.
Figure 1B:
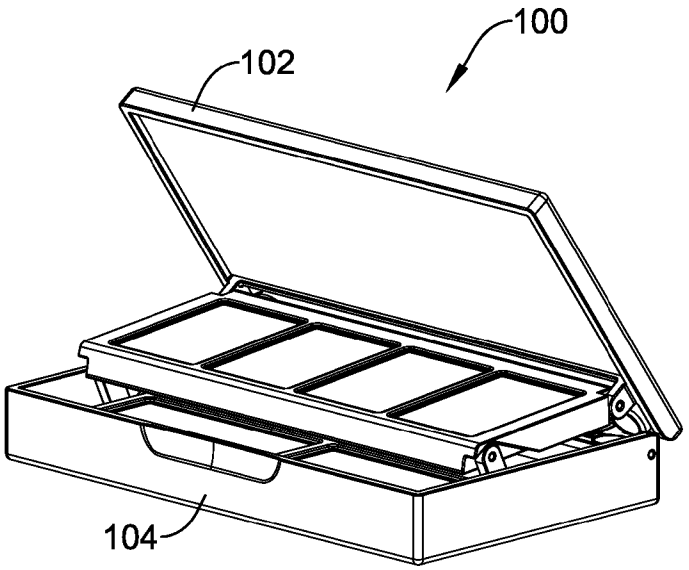
FIG. 1B is a perspective view of the multiple level container shown in FIG. 1A in a partially open position according to some embodiments disclosed herein.
Figure 1C:
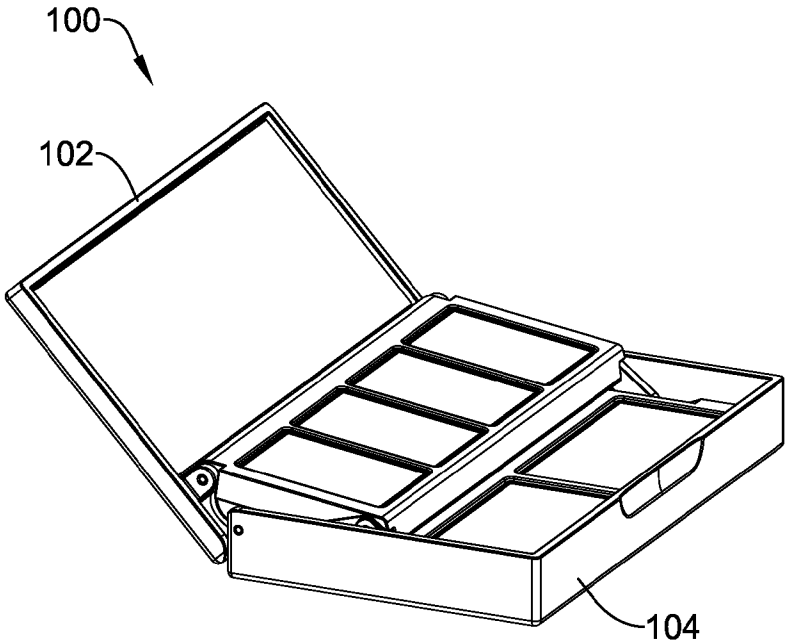
FIG. 1C is a perspective view of the multiple level container shown in FIG. 1A in an open position according to some embodiments disclosed herein.
Figure 1D:
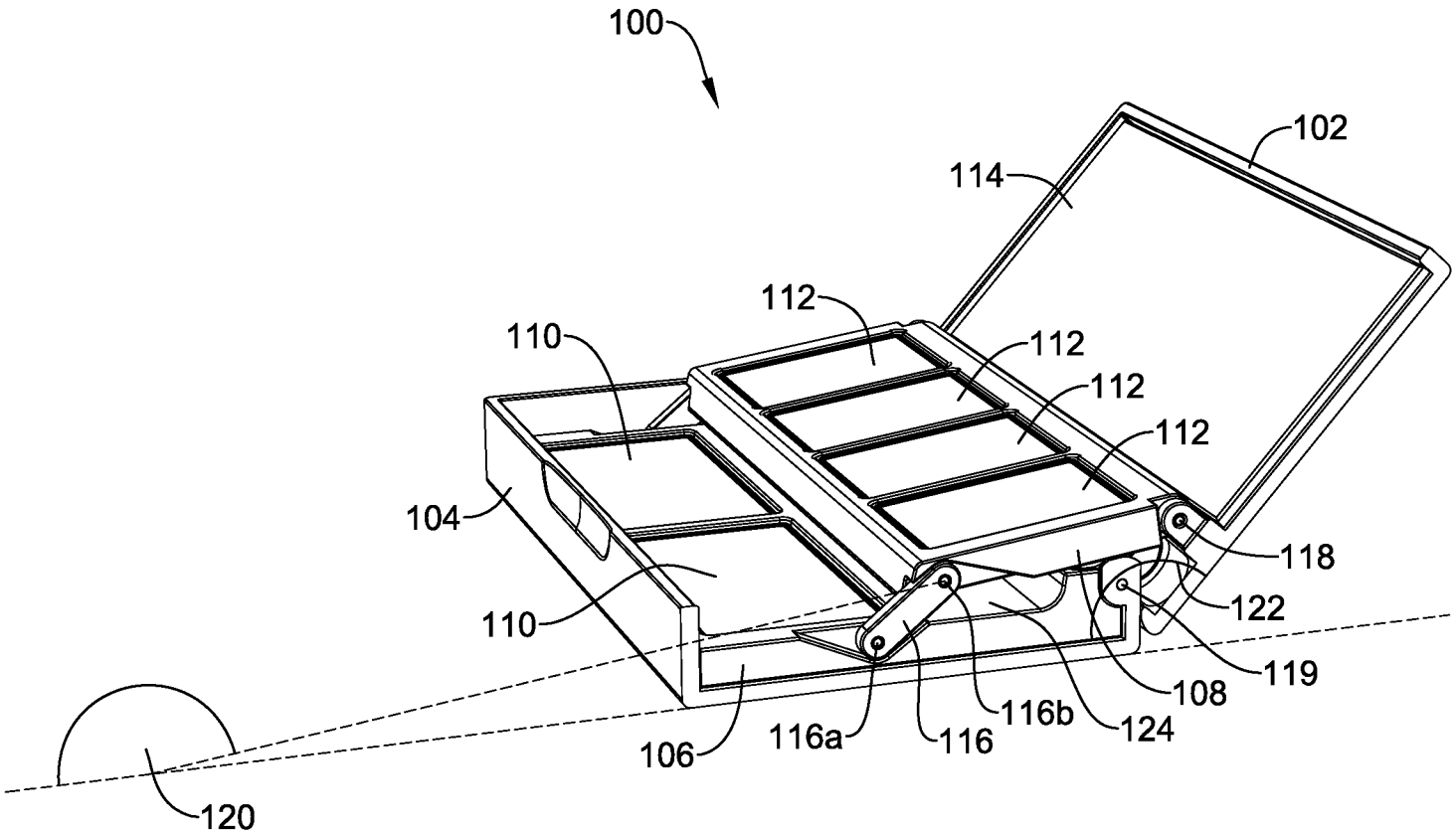
FIG. 1D is a partial cross sectional perspective view of the multiple level container shown in FIG. 1A in an open position according to some embodiments disclosed herein.

FIG. 1A through FIG. 1D show perspective views of an exemplary multiple level container. FIG. 1A is a perspective view of a multiple level container in a closed position according to embodiments disclosed herein. FIG. 1B is a perspective view of the multiple level container shown in FIG. 1A in a partially open position according to embodiments disclosed herein. FIG. 1C is a perspective view of the multiple level container shown in FIG. 1A in an open position according to embodiments disclosed herein. FIG. 1D is a partial cross sectional perspective view of the multiple level container shown in FIG. 1A in an open position according to embodiments disclosed herein.

Referring generally to FIG. 1A through FIG. 1D, multiple level container 100 may include a lid 102 and a base 104. The size and shape of the multiple level container 100 and each portion of the multiple level container 100 is merely exemplary. Embodiments may include multiple level containers having other shapes and sizes. As shown in FIG. 1D, lid 102 may also include a mirror 114. Embodiments may include multiple level containers having no mirror.

The container 100 may include a first level 106 and a second level 108. The first level 106 may include a plurality of first level compartments 110 and the second level 108 may include a plurality of compartments 112. The size, shape and number of compartments 110 and 112 shown are merely exemplary. Embodiments may include any number of compartments (including zero) having shapes and sizes different from those shown in FIG. 1D. Exemplary compartments may be used to hold any type of product, but may be particularly well suited for cosmetics that may include, but are not limited to loose powders (e.g., for eye, cheek, face, and the like), creams (e.g., skincare, eye, foundation, and the like), sunscreen, hot pour products (e.g., lipsticks, glosses, and the like), touchup, spot cover, baked powders, moisturizers, hair creams, gels, serums, and the like.

In the embodiment shown in FIG. 1D, both first level 106 and second level 108 hold cosmetics to be applied to users (not shown). Embodiments may, however, include first or second levels holding any type of product, such as sponges, applicators or cosmetics to be applied to users or combinations of different types of products.

As shown in FIG. 1D, the container 100 may include a first linkage assembly 116 coupled between the base 104 and the second level 108. As shown in FIG. 1D, the first linkage assembly 116 is coupled to the first level 106 and the second level 108. In some embodiments, the first linkage assembly 116 may not be coupled to the first level 106. For example, embodiments may include linkage assemblies coupled directly to bases (e.g., a side of the base). As shown in FIG. 1D, first linkage assembly 116 includes two pivot points 116*a* and 116*b*. Accordingly, the second level 108 is configured to move about an axis at pivot point 116*a* and about an axis at pivot point 116*b*. It can also be seen by comparing FIG. 1D and FIG. 2B that the first linkage assembly 116 pivot point 116*a* sits in a receiving portion of the base of the perimeter which limits movement of the first linkage assembly from the position shown in FIG. 1D, where it is at its most rearward extreme to define an access position, and the position in FIG. 2B, where the first linkage assembly is completely forward to define a closed position. In some embodiments, one or more pivot locations may be sufficiently tight as to hold the lid and second level in a fixed position between these two extremes.

The container 100 may also include a second linkage assembly 118 coupled between the second level 108 and the lid 102. As shown in FIG. 1D, the container 100 may also include a hinge assembly 119 coupled between the base 104 and the lid 102. Accordingly, the lid 102 may be configured to rotate about an axis of the hinge assembly 119 as the lid 102 opens and closes.

The size, shape and number of linkage assemblies 116 and 118 shown in FIG. 1D are exemplary. Embodiments may include any number of linkage assemblies having sizes, shapes configured to facilitate movement (e.g., opening and closing) of exemplary lids and second levels relative to container bases.

As shown in FIG. 1D, the lid 102 and the second level 108 may be opened to an access position. The access position may occur when the lid 102 has opened to a position such that the lid is prevented from opening further. In some embodiments, containers may be configured to include several access positions. For example, containers may include one or more latches (not shown) to hold the container in multiple access positions.

In the access position in FIG. 1D, the second level 108 is at second level angle 120 relative to the base 104 and lid 102 is at lid angle 122 relative to the base 104. In the embodiment shown at FIG. 1D, second level angle 120 is about 172 degrees relative to the base 104 and the lid angle 122 is about 135 degrees relative to the base 104. Embodiments may include multiple level containers that open to a position having second level angles in the range of about 110 degrees and 180 degrees relative to their bases and preferably in the range of about 145 degrees and 170 degrees relative to their bases. Embodiments may also include multiple level containers that open to a position having lid angles in the range of about 90 degrees and 180 degrees relative to their bases and preferably in the range of about 115 degrees and 155 degrees relative to their bases. The range of second level angles relative to container bases may be selected based on various factors including facilitating a view of the products in the second level and facilitating the application of a product to an applicator not shown. The range of lid angles relative to container bases may be determined based on various factors including facilitating views of users (not shown) in mirrors on lids, such as mirror 114, as well as preventing containers from tipping over.

As shown in FIG. 1D, the first level 106 of container 100 may also include an area 124 adjacent to compartments 110 and below the second level 108. In some embodiments, one or more magnets (not shown) may be disposed within area 124. The one or more magnets may be used to facilitate holding the lid 102 closed. In some embodiments, an applicator or sponge (not shown) may be disposed within area 124. In these embodiments, second level 108 may be moved to access the sponge or applicator. In other embodiments, a drawer (not shown) may be disposed within area 124 which may be configured to slide in and out of the area and may be configured to hold one or more additional products or applicators.

FIG. 2A through 7B are side views and corresponding perspective views of the multiple level container 100 illustrating the multiple level container 100 at different states according to embodiments disclosed herein. In each of the views shown in FIG. 2A through 7B, the angles of the lid 102 relative to the base 104 are exemplary and the angles of the second level 108 relative to the base 104 are exemplary. Further, the position of the linkage assemblies 116 and 118 shown in FIG. 2A through 7B are also exemplary.

Figure 2B:
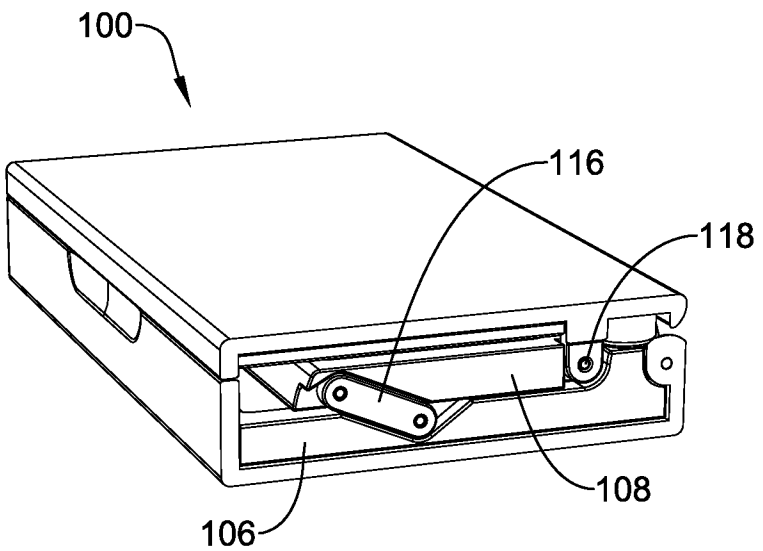
FIG. 2A through 7B are side views and corresponding perspective partial cutaway views of the multiple level container illustrating the multiple level container at different states according to embodiments disclosed herein.
Figure 2A:
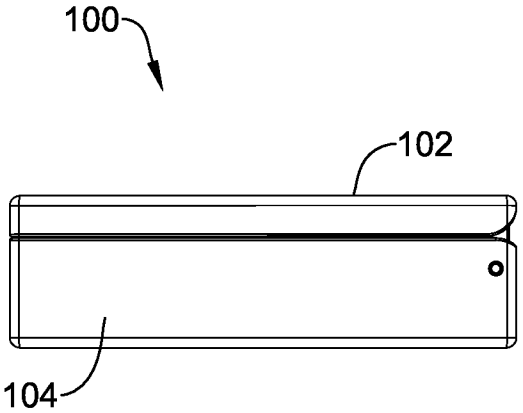

FIG. 2A is a side view of the multiple level container when the container 100 is in a closed position. FIG. 2B is a corresponding perspective and partial cutaway view of the multiple level container 100 when the container 100 is in a closed position. As shown in FIG. 2B, when the container 100 is in a closed position, the second level 108 is substantially parallel to and abutting the first level 106, linkage assembly 116 is neither parallel nor perpendicular to second level 108 and first level 106 and linkage assembly 118 is perpendicular to second level 108 and first level 106. Although the second level 108 shown in FIG. 1D is abutting the first level 106, some embodiments may include second levels proximate to but not abutting first levels when the container 100 is in a closed position.

Figure 3B:
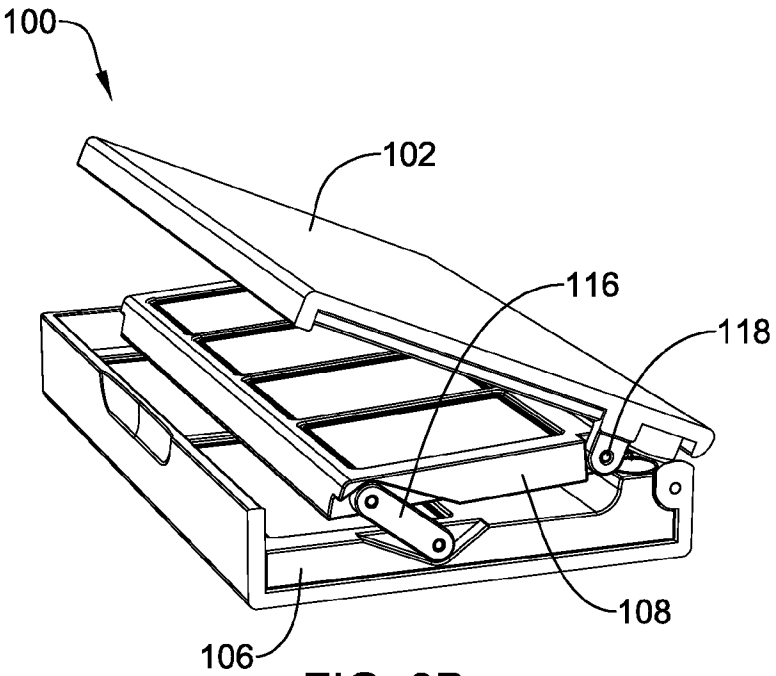
Figure 3A:
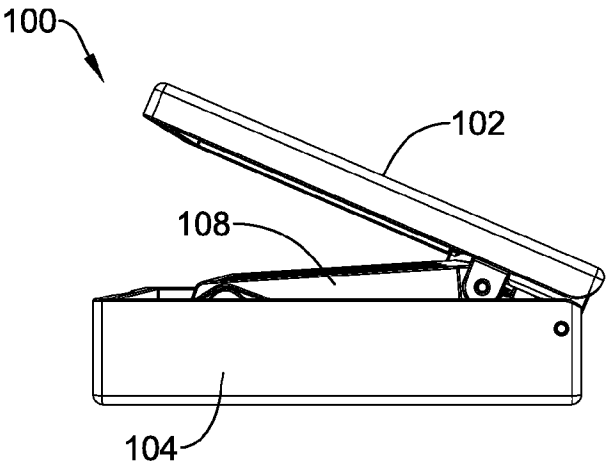
Figure 4B:
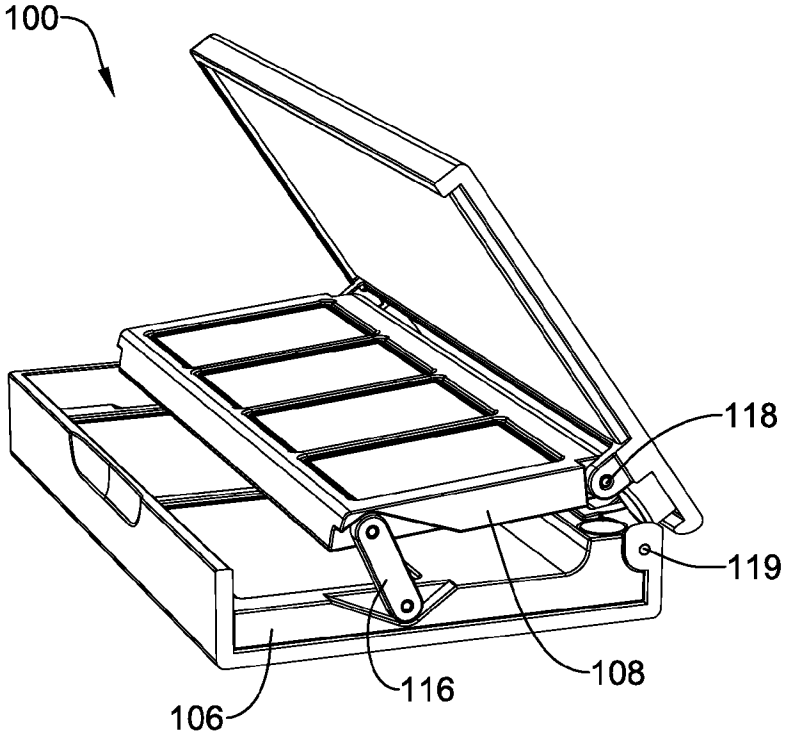
Figure 4A:
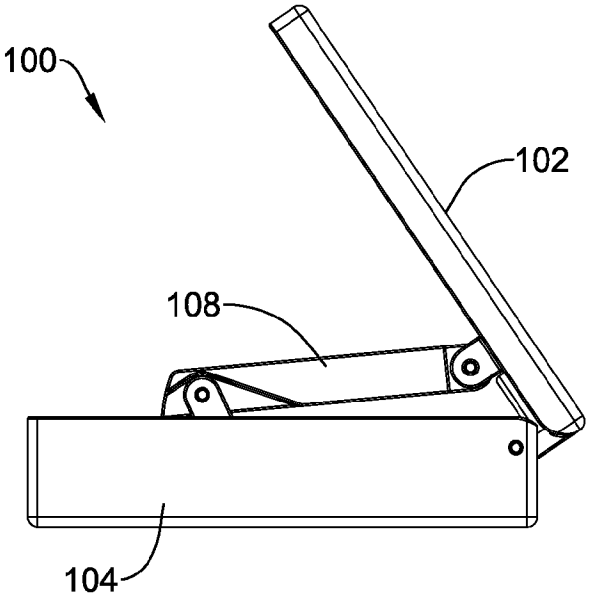
Figure 5B:
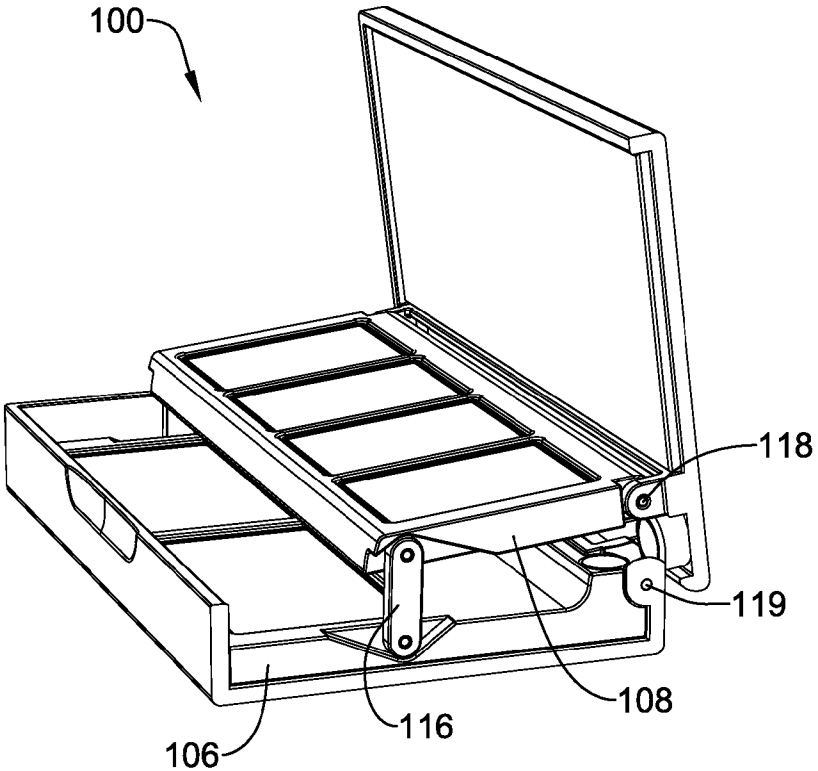
Figure 5A:
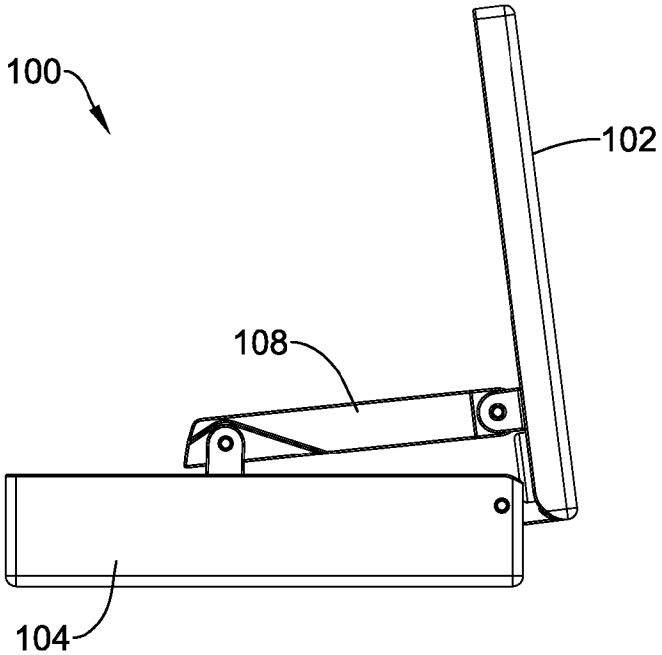
Figure 6B:
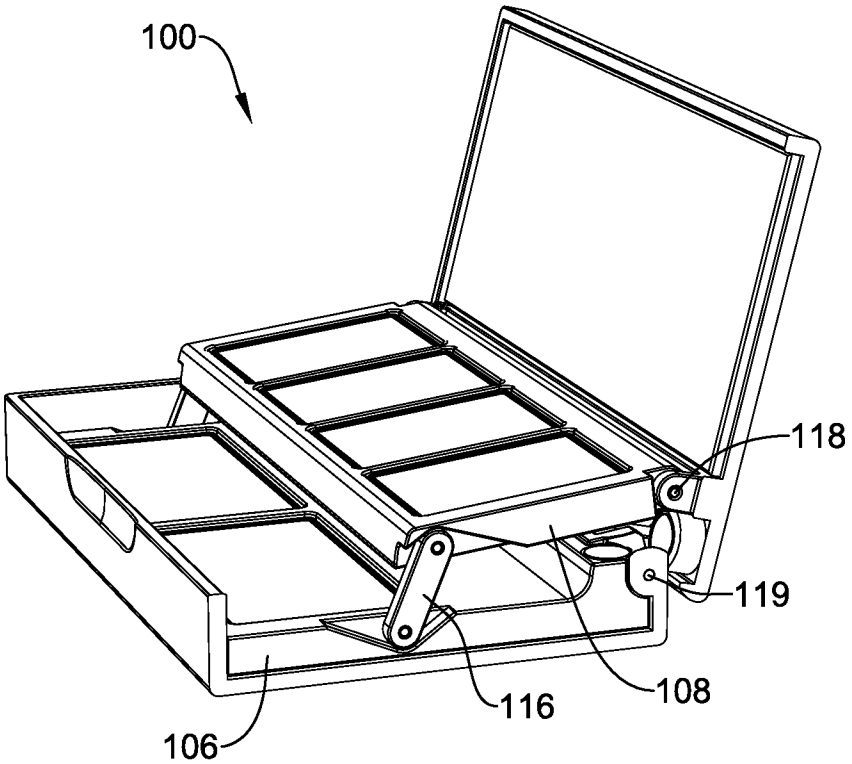
Figure 6A:
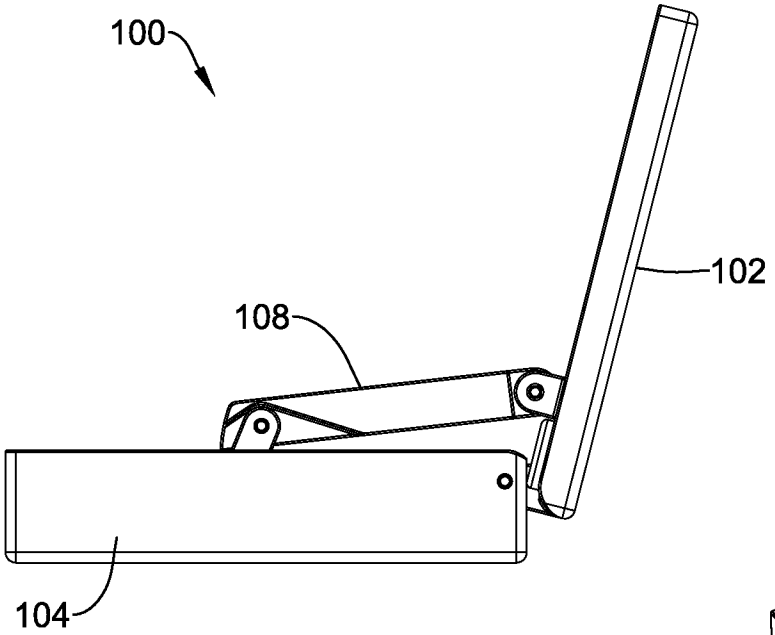

FIG. 3A is a side view of the multiple level container in a partially open position. FIG. 3B is a corresponding perspective and partial cutaway view of the multiple level container 100 when the container 100 is in a closed position. As the container 100 begins to open to the position shown in FIGS. 3A and 3B, the second level 108 includes movement that is a function of the movement of the lid 102. For example, when lid 102 rotates about an axis of the hinge assembly 119 and is moved from its position shown in FIG. 2A and FIG. 2B to its position shown in FIG. 3A and FIG. 3B, second level 108 pivots via linkage assemblies 116 and 118 to its position shown in FIG. 3A and FIG. 3B.

Figure 7B:
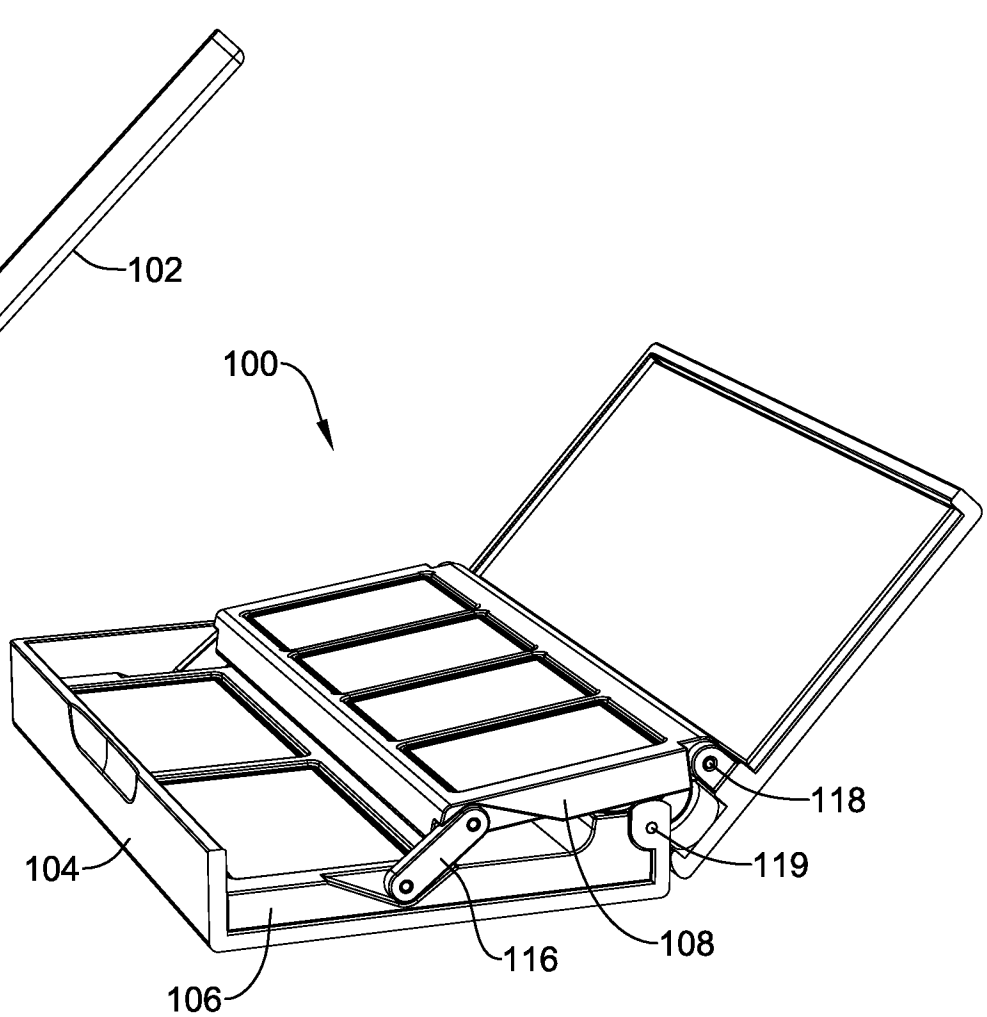
Figure 7A:
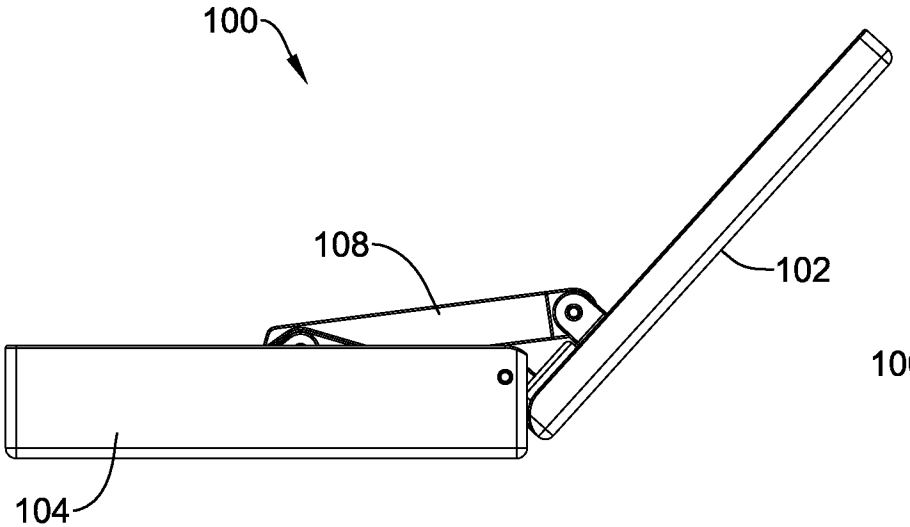

As the container 100 continues to open, lid 102 continues to rotate about the axis of the hinge assembly 119 to its corresponding positions shown in FIG. 3A through FIG. 7B and second level 108 continues to move as a function of the movement of the lid 102 to its corresponding positions shown in FIG. 3A through FIG. 7B. As shown in FIGS. 7A and 7B, container 100 is in an access position. When in this access position, a user may simultaneously access first level 106 and second level 108.

A first non-limiting example takes the form of a multiple level container comprising a base comprising a base perimeter, a lid configured to be pivotably coupled to the base, a first level disposed within the base and comprising one or more first level compartments, a second level coupled between the lid and the base and comprising one or more second level compartments, a lid hinge assembly coupling the base and the lid, a first linkage assembly coupled between the base and the second level, and a second linkage assembly coupled between the second level and the lid, wherein the linkages and lid hinge assembly are configured and arranged such that when the lid is opened from a closed position to an access position, the lid rotates via the lid hinge and the second level pivots via the first linkage assembly and the second linkage assembly to provide simultaneous access to the one or more first level compartments and the one or more second level compartments.

A second non-limiting example takes the form of a multiple level container as in the first non-limiting example, wherein, when the lid is in the closed position, the lid, the second level and the first level are substantially parallel to each other, and when the lid is opened to the access position, the second level is configured to be at a second level angle relative to the base and the lid is configured to be at a lid angle relative to the base, the second level angle and the lid angle each being greater than zero degrees.

A third non-limiting example takes the form of a multiple level container as in the second non-limiting example, wherein when the lid is in the access position, the second level angle is within a range of about 110 degrees to about 180 degrees and the lid angle is within a range of about 90 degrees to about 180 degrees.

A fourth non-limiting example takes the form of a multiple level container as in the second non-limiting example, wherein, when the lid is in the access position, the second level angle is in a range of about 145 degrees to about 170 degrees and the lid angle is in the range of about 115 degrees to about 155 degrees.

A fifth non-limiting example takes the form of a multiple level container as in any of the first to fourth non-limiting examples, wherein, when the lid is in the access position, the second level is at an angle with respect to the first level.

A sixth non-limiting example takes the form of a multiple level container as in any of the first to fifth non-limiting examples, wherein the base perimeter comprises at least one receiving portion for receiving the first linkage assembly, wherein movement of the first linkage assembly is limited by the receiving portion to establish the closed position and the access position.

A seventh non-limiting example takes the form of a multiple level container as in any of the first to sixth non-limiting examples, wherein at least one of the first level compartments and second level compartments are configured to contain an applicator configured to apply a cosmetic product to a user.

An eighth non-limiting example takes the form of a multiple level container as in any of the first to seventh non-limiting examples, wherein at least one of the first level compartments and second level compartments are configured to contain one or more cosmetic products.

A ninth non-limiting example takes the form of a multiple level container as in any of the first to eighth non-limiting examples, wherein the lid contains a mirror configured such that, in the access position, the mirror allows the user to see himself or herself Additional non-limiting examples may be as any of the first to ninth non-limiting examples, further wherein there are more than one first levels and/or more than one second levels.

The drawings, which are not necessarily to scale, show illustrative embodiments. The size, shape, and dimensions of the exemplary multiple level containers shown throughout are merely exemplary. In the embodiments shown throughout, the container 100 includes two levels. Embodiments may however, include any number of levels and may include additional linkage assemblies.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

What is claimed is:

1. A multiple level container comprising:

a base comprising a base perimeter;

a lid configured to be pivotably coupled to the base, a first level disposed within the base and comprising one or more first level compartments;

a second level coupled between the lid and the base and comprising one or more second level compartments, the second level having a first end and a second end opposite the first end;

a lid hinge assembly coupling the base and the lid;

a first linkage assembly coupling the base and the second level, the first linkage assembly having a first end coupled to the base at a first pivot point and a second end coupled to the first end of the second level at a second pivot point; and a second linkage assembly coupling the second end of the second level and the lid, wherein the lid hinge assembly and linkages are configured and arranged such that, when the lid is opened from a closed position to an access position, the lid rotates via the lid hinge assembly and the second level pivots via the first linkage assembly and the second linkage assembly to provide simultaneous access to the one or more first level compartments and the one or more second level compartments.

2. The multiple level container according to claim 1, wherein:

when the lid is in the closed position, the lid, the second level and the first level are substantially parallel to each other, and when the lid is opened to the access position, the second level is configured to be at a second level angle relative to the base and the lid is configured to be at a lid angle relative to the base, the second level angle and the lid angle each being greater than zero degrees.

3. The multiple level container according to claim 2, wherein when the lid is in the access position, the second level angle is within a range of about 110 degrees to about 180degrees and the lid angle is within a range of about 90 degrees to about 180 degrees.

4. The multiple level container according to claim 2 wherein, when the lid is in the access position, the second level angle is in a range of about 145 degrees to about 170degrees and the lid angle is in the range of about 115 degrees to about 155 degrees.

5. The multiple level container according to claim 1, wherein, when the lid is in the access position, the second level is at an angle with respect to the first level.

6. The multiple level container according to claim 1 wherein the base perimeter comprises at least one receiving portion for receiving the first linkage assembly, wherein movement of the first linkage assembly is limited by the receiving portion to establish the closed position and the access position.

7. The multiple level container according to claim 1, wherein at least one of the first level compartments and second level compartments are configured to contain an applicator configured to apply a cosmetic product to a user.

8. The multiple level container according to claim 1, wherein at least one of the first level compartments and second level compartments are configured to contain one or more cosmetic products.

9. The multiple level container according to claim 1, wherein the lid contains a mirror configured such that, in the access position, the mirror allows the user to see himself or herself.

10. A multiple level container comprising:

a base comprising a base perimeter;

a lid configured to be pivotably coupled to the base, at least one first level disposed within the base and comprising one or more first level compartments;

at least one second level coupled between the lid and the base and comprising one or more second level compartments, the at least one second level having a first end and a second end opposite the first end;

a lid hinge assembly coupled between the base and the lid;

a first linkage assembly coupled between the base and the at least one second level, the first linkage assembly having a first end pivotably secured at a first location on the base and a second end pivotably secured at a second location on the first end of the at least one second level; and a second linkage assembly coupled between the second end of the at least one second level and the lid, wherein when the lid is opened, the lid rotates via the lid hinge and the at least one second level pivots via the first linkage assembly and the second linkage assembly to provide simultaneous access to first level compartments and the second level compartments.

11. The multiple level container according to claim 10, wherein:

when the lid is in the closed position, the lid, the second level and the first level are substantially parallel to each other, and when the lid is opened to the access position, the second level is configured to be at a second level angle relative to the base and the lid is configured to be at a lid angle relative to the base, the second level angle and the lid angle each being greater than zero degrees.

12. The multiple level container according to claim 11, wherein when the lid is in the access position, the second level angle is within a range of about 110 degrees to about 180 degrees and the lid angle is within a range of about 90 degrees to about 180 degrees.

13. The multiple level container according to claim 11 wherein, when the lid is in the access position, the second level angle is in a range of about 145 degrees to about 170degrees and the lid angle is in the range of about 115 degrees to about 155 degrees.

14. The multiple level container according to claim 10, wherein, when the lid is in the access position, the second level is at an angle with respect to the first level.

15. The multiple level container according to claim 10 wherein the base perimeter comprises at least one receiving portion for receiving the first linkage assembly, wherein movement of the first linkage assembly is limited by the receiving portion to establish the closed position and the access position.

16. The multiple level container according to claim 10, wherein at least one of the first level compartments and second level compartments are configured to contain an applicator configured to apply a cosmetic product to a user.

17. The multiple level container according to claim 10, wherein at least one of the first level compartments and second level compartments are configured to contain one or more cosmetic products.

18. The multiple level container according to claim 10, wherein the lid contains a mirror configured such that, in the access position, the mirror allows the user to see himself or herself.

19. The multiple level container of claim 10 wherein the base includes an angled slot and the first location is fixed in a single point at the bottom of the angled slot, the angled slot having a first edge and a second edge such that, when the lid is closed, the first linkage assembly is adjacent the first edge, and when the lid is open in the access position, the first linkage assembly is adjacent the second edge.

20. The multiple level container of claim 1 wherein base includes an angled slot and the first pivot point is fixed in a single point at the bottom of the angled slot, the angled slot having a first edge and a second edge such that, when the lid is closed, the first linkage assembly is adjacent the first edge, and when the lid is open in the access position, the first linkage assembly is adjacent the second edge.

* * * * *